United States Patent [19]

Britsch

[11] Patent Number: 4,506,633

[45] Date of Patent: Mar. 26, 1985

[54] INTERNAL COMBUSTION ENGINE

[75] Inventor: Heinz Britsch, Bietigheim-Bissingen, Fed. Rep. of Germany

[73] Assignee: Robert Bosch GmbH, Stuttgart, Fed. Rep. of Germany

[21] Appl. No.: 393,352

[22] Filed: Jun. 29, 1982

[30] Foreign Application Priority Data

Jun. 30, 1981 [DE] Fed. Rep. of Germany ..... 3125647

[51] Int. Cl.[3] ..... F02M 25/06; F02B 75/00

[52] U.S. Cl. ..... 123/59 EC; 123/315; 123/568

[58] Field of Search ..... 123/59 EC, 59 BM, 315, 123/568, 198 F

[56] References Cited

U.S. PATENT DOCUMENTS

| | | | |
|---|---|---|---|
| 3,861,367 | 1/1975 | Kelmar | 123/568 |
| 4,024,708 | 5/1977 | Takemoto | 123/568 |
| 4,100,734 | 7/1978 | Ozaki et al. | 123/568 |
| 4,131,095 | 12/1978 | Ouchi | 123/59 EC |
| 4,151,715 | 5/1979 | Tachibana et al. | 123/568 |
| 4,237,832 | 12/1980 | Hartig et al. | 123/198 F |
| 4,250,850 | 2/1981 | Ruyer | 123/198 F |

*Primary Examiner*—Andrew M. Dolinar
*Assistant Examiner*—David A. Okonsky
*Attorney, Agent, or Firm*—Michael J. Striker

[57] ABSTRACT

An internal combustion engine has a fuel supply, an accumulating container, first and second blocking elements, and a plurality of cylinders of which at least one cylinder is separable from the fuel supply by the first blocking element and connected at its outlet side to the accumulating container, and at least another of the cylinders is connected at its inlet side with the accumulating container and is separable from the fuel supply by the second blocking element.

16 Claims, 3 Drawing Figures

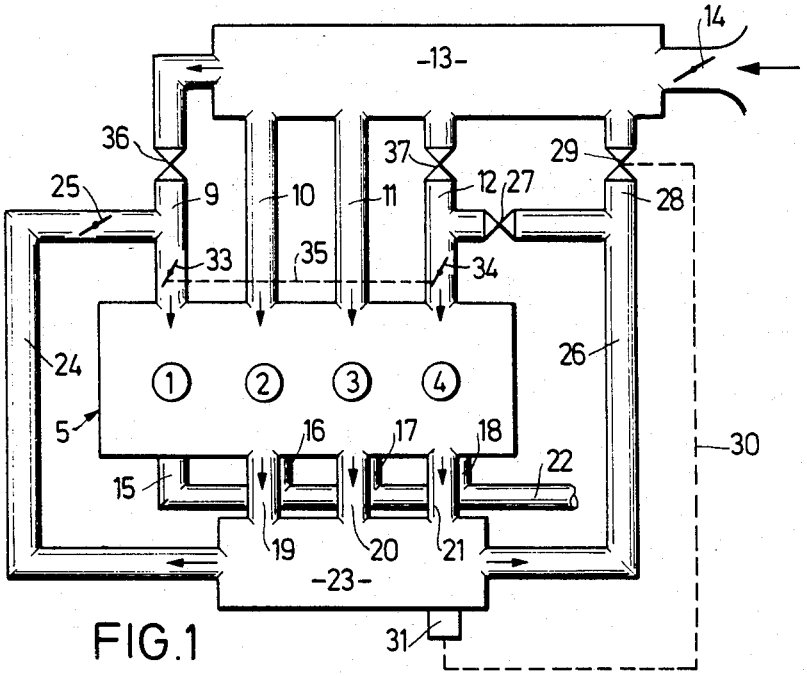
FIG.1
FIG. 2
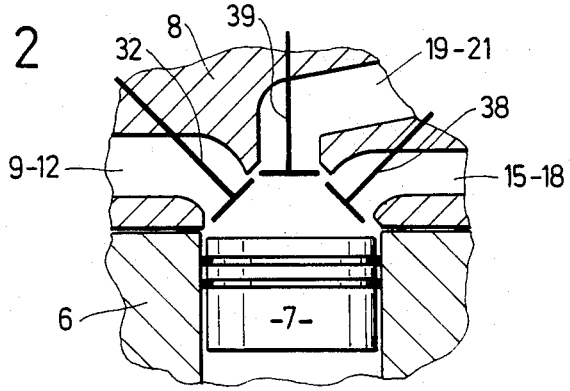

INTERNAL COMBUSTION ENGINE

BACKGROUND OF THE INVENTION

The present invention relates to an internal combustion engine, more particularly to an internal combustion engine which has a plurality of cylinders differently used for starting and operation.

Internal combustion engines of the above mentioned general type are known in the art. One such internal combustion engine is disclosed, for example, in German Auslegeschrift DE-AS No. 2,454,829. In this internal combustion engine, at least one cylinder is used for receiving exhaust gases produced from combustion in at least one other cylinder. This cylinder is directly connected by its inlet conduit to an outlet conduit of the other cylinder. The cylinder which is determined for receiving the exhaust gases has another dimension for its combustion chamber and a higher compression ratio than the other cylinder. When the internal combustion engine is designed in accordance with this construction, a returnd part of the exhaust gases from the working cylinders is cooled regardless of the outer cooling system to a damage-reducing temperature and makes possible easy starting of this engine.

Another known internal combustion engine of this type is disclosed in German Offenlegungsschrift DE-OS No. 2,325,060 and has two cylinder groups, of which one cylinder group is used for starting and the other cylinder group is used for operation with a normal engine efficiency. It provides for good starting ability with a high efficiency and reduced mechanical loading. Both the above described constructions have the tendency to make the diesel engines ready to start, on the one hand, and do not excessively increase the combustion values to reduce the yield of carbon dioxide, on the other hand. All these features are not suitable to provide for equally good utilization of the fuel in all operational conditions. In particular, the Otto engines show the disadvantage in that they have, in the partial loading region, a low temperature of the fuel-air mixture at the end of the compression stroke. The ignition and the combustion are thereby poor. The fuel is not used in optimal manner. The known filling of the combustion chamber by charging improves the combustion considerably in the full-load region.

SUMMARY OF THE INVENTION

Accordingly, it is an object of the present invention to provide an internal combustion engine which avoids the disadvantages of the prior art.

More particularly, it is an object of the present invention to provide an internal combustion engine in which, during the starting, in the partial-load region, and in the full-load region, the combustion of the fuel results in a higher energy level.

It is also an object of the present invention to provide an internal combustion engine in which for optimum fuel utilization advantages of charging during start-up and in the partial-load region are utilized, without an additional compressor. This is attained by providing a correspondence of the number of cylinders used for ignition as motors to the power requirement and the utilization of the cylinders not supplied with fuel and ignited and used as superchargers.

In keeping with these objects and with others which will become apparent hereinafter, one feature of the present invention resides, briefly stated, in an internal combustion engine having fuel supply means, an accumulator container, and a plurality of cylinders, wherein at least one of the cylinders is separable from the fuel supply means by first blocking means and connected at its outlet side with the accumulating container for a medium aspirated therethrough, whereas at least another of the cylinders is connected at its inlet side with the accumulating container and separable from the fuel supply means by second blocking means.

When the internal combustion engine is designed in accordance with these features, it attains the above mentioned highly advantageous results.

It is especially advantageous to use throttles only in the aspiration path of the cylinder which is used for ignition as the motor. With the not throttled aspiration of the medium (air) in the cylinder which is not supplied with fuel and ignited, the charge exchange work is considerably reduced. By the partial exhaust gas return via the accumulating container, the fuel utilization is further improved. The carbon dioxide emission is decreased.

The novel features which are considered characteristic for the invention are set forth in particular in the appended claims. The invention itself, however, both as to its construction and its method of operation, together with additional objects and advantages thereof, will be best understood from the following description of specific embodiments when read in conjunction with the accompanying drawing.

BRIEF DESCRIPTION OF THE DRAWING

FIG. 1 is a view schematically showing an internal combustion engine in accordance with a first embodiment of the present invention;

FIG. 2 is a view showing a partial section of a cylinder block and a cylinder head for one cylinder of the internal combustion engine shown in FIG. 1.

DESCRIPTION OF THE PREFERRED EMBODIMENTS

Figure 3:
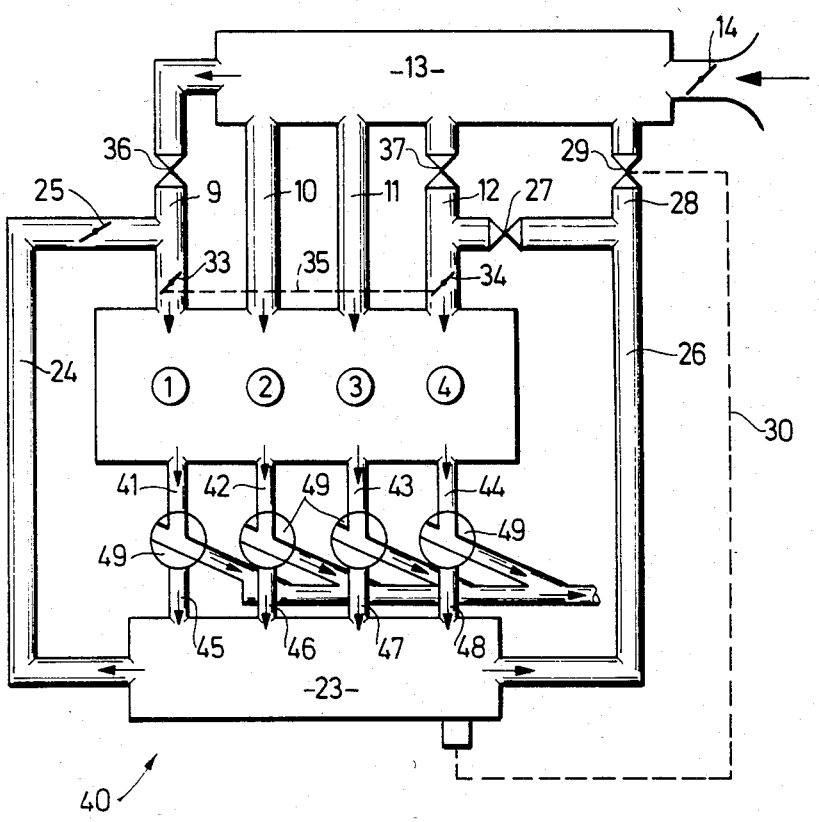
FIG. 3 is a view schematically showing an internal combustion engine in accordance with a second embodiment of the invention.

An internal combustion engine in accordance with the present invention is identified by reference numeral 5 and has cylinders 1, 2, 3 and 4. The cylinders 1–4 are arranged in a cylinder block 6 and have pistons 7.

A cylinder head is identified by reference numeral 8 and forms, at least partially, inlet passages 9, 10, 11 and 12. The inlet passages 9–12 open in a common aspirating conduit 13. A first throttle 14 is arranged in an inlet opening of the common aspirating conduit 13. The cylinder head 8 forms partially also outlet passages 15, 16, 17 and 18. Finally, it forms also additional outlet passages 19, 20 and 21 for the cylinders 2, 3 and 4. The outlet passages 15–18 open in a known manner in a common outlet passage 22. As for the additional outlet passages 19–21, they open in an accumulating container 23. The accumulating container is connected via a passage 24 with the inlet passage 9 for the cylinder 1. A second throttle 25 is arranged in the passage 24.

Another passage 26 leads from the accumulating container 23 to the inlet passage 12 for the cylinder 4. A check valve 27 is arranged in the passage 26 prior to its opening into the inlet passage 12. A branch 28 of the passage 26 leads via a pressure-regulating valve 29 to the common aspirating conduit 13. A control conduit 30 connects the pressure-regulating valve 29 with a sensor 31 on the accumulating container 23. All inlet passages 9–12 are provided in a known manner with valves 32.

The inlet passages 9 and 12 are additionally provided with throttles. A third throttle 33 is located in the inlet passage 9, and a fourth throttle 34 is located in the inlet passage 12. The throttles 33 and 34 are mechanically coupled by a rod 35. A check valve 36 is located in the inlet passage 9 between the opening of the passage 24 and the connecting point to the common aspirating conduit 13. The inlet passage 12 is provided in the same manner with a check valve 37.

The outlet passages 15–18 are closable in a known manner by valves 38. For closing the additional outlet passages 19–21, valves 39 are provided which can be designed as the other inlet and outlet valves. The valves 39 are exclusively, and the valves 39 are additionally controllable by not shown electronic performance-control device, which is disclosed, for example, in U.S. Pat. No. 4,009,695. Only in the working condition of the internal combustion engine in which the valves 39 open the additional outlet passages 19–21, does the additional control of the valves 38 take place. The valves 39 are opened during the compression stroke of the piston 7, and the valves 38 are opened prematurely in the displacement phase of the piston, in which during normal operation the working stroke takes place. The additional control of the valves 38 can, however, be dispensed with.

The operation of the internal combustion engine can be subdivided as an example into three phases. In phase one for the start, the idle running, and town driving in the lower power range, the first throttle 14, the third throttle 33 and the fourth throttle 34 are fully open. The check valves 36 and 27 are closed, and the cylinders 2, 3 and 4 are separated from the fuel supply. The desired power is adjusted by the second throttle 25. A medium (here air) is aspirated into cylinders 2, 3 and 4 without throttling, and after closing the inlet passages 10, 11 and 12 is pressed via the then opened additional outlet passages 19, 20 and 21 into the accumulating container 23. From there, the cylinder 1 supplied with the fuel via the passage 24 is charged and ignited.

During the subsequent working cycle of cylinder 1, the valves 39 hold the additional passages 19, 20 and 21 closed, whereas the valves 38 open the outlet passages 16, 17 and 18. This takes place in order to avoid the energy loss which would occur with the generation of a vacuum in the cylinders 2, 3 and 4.

It is to be understood that this can be accepted, or the inlet passages 10, 11 and 12 are open. As soon as the pressure in the accumulating container 23 reaches a limiting value provided for charging, the pressure-regulating valve 29 is opened in response to the signal from the sensor 31, and the air surplus is supplied back to the common aspirating conduit. As soon as the second throttle 25 is fully opened, or also when the gas pedal pressure further increases, the internal combustion engine 5 is switched to its second working phase.

In the working phase 2, the check valves 36 and 37 are closed, the check valve 27 opens a first throttle 14, and the second throttle 25 is fully opened, and only the cylinders 2 and 3 are separated from the fuel supply. The desired power is adjusted by adjusting of the third throttle 33 and the fourth throttle 34. The air aspirated via the cylinders 2 and 3 is pressed in the above described manner into the accumulating container 23. From there, the cylinder 1 is charged via the passage 24, and the cylinder 4 via the passage 26. The additional outlet passage 21 to the cylinder 4 remains closed. The ignited cylinders 1 and 4 work as motors (prime movers) and generate a power which corresponds to a medium partial load. The cylinders 2 and 3 work as chargers for the cylinders 1 and 4. When the upper power limit of the cylinders 1 and 4 after full opening of the third throttle 33 and the fourth throttle 34 is reached, the transition to the third working phase can take place.

The third working phase embraces the range of high partial load and full load. The check valves 36 and 37 are opened, the check valve 27 is closed. All four cylinders are supplied with fuel and ignited. The desired power is adjusted in a manner known by the throttle 14. All additional outlet passages 19, 20 and 21 remain closed.

An internal combustion engine in accordance with a second embodiment of the pesent invention is shown in FIG. 3. It does not have separate additional outlet passages 19–21. The internal combustion in accordance with this embodient is identified by reference numeral 40 and has outlet passages 41, 42, 43 and 44 which are subdivided into two passages. Branching passages 45, 46, 47 and 48 lead to the accumulating container 23. At the locations of the branchings, reversing valves 49 are provided.

The operation of the internal combustion engine 40 is similar to the operation of the internal combustion engine 5. Instead of the additional outlet passages and their valves 39 and the additional control of the valves 38, the different modes of operation are adjusted at the outlet side by the reversing valves 49. The provision of the reversing valves 49 in the outlet passage 41 serves the purpose of connecting an exhaust gas return with the charging and the working phases 1 and 2. The exhaust gas from the cylinder 1 or 4 is sufficiently cooled by mixing with the fresh air from the cylinders 2–4 or 2 and 3, in order to reduce the exhaust of carbon dioxide. On the other hand, this increases the igniting ability because of heating of the fuel-air mixture.

It will be understood that each of the elements described above, or two or more together, may also find a useful application in other types of constructions differing from the types described above.

While the invention has been illustrated and described as embodied in an internal combustion engine, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An internal combustion engine, comprising a plurality of cylinders each having inlet and outlet sides and used differently for starting and operation; fuel supply means; an accumulating container; a plurality of aspirating passages each for a respective one of said cylinders; first blocking means; second blocking means, at least one of said cylinders being separable from said fuel supply means by said first blocking means and connected at its outlet side with said accumulating container for a medium aspirated therethrough, and at least another of said cylinders being connected at its inlet side with said accumulating container and separable from said fuel supply means by said second blocking means; and separate throttles provided in the aspirating passages of both said one and said other cylinders, each of said first and second blocking means including a check valve arranged in the aspirating passage of a respective one of said one and other cylinders provided with said separate throttles.

2. An internal combustion engine as defined in claim 1; and further comprising two connecting passages each connecting said accumulating container with a respective one of said one and other cylinders and having an inlet to the inlet side of the latter, each of said check valves being located between the inlets of a respective one of said connecting passages and said aspirating passage.

3. An internal combustion engine as defined in claim 2; and further comprising at least one further check valve arranged in at least one of said connecting passages.

4. An internal combustion engine, comprising a plurality of cylinders each having inlet and outlet sides and used differently for starting and operation; fuel supply means; an accumulating container; first blocking means; and second blocking means, at least one of said cylinders being separable from said fuel supply means by said first blocking means and connected at its outlet side with said accumulating container for a medium aspirated therethrough, and at least another of said cylinders being connected at its inlet side with said accumulating container and separable from said fuel supply means by said second blocking means, said cylinders which are separable from said fuel supply means each having an additional outlet connected with said accumulating container via an additional outlet passage.

5. An internal combustion engine as defined in claim 4; and further comprising a plurality of aspirating passages each for a respective one of said cylinders, the aspirating passages of at least one of said one and other cylinders being provided with a separate throttle.

6. An internal combustion engine as defined in claim 5, wherein the aspirating passages of both said one and said other cylinders are provided with such separate throttles.

7. An internal combustion engine as defined in claim 4, wherein said fuel supply means includes a common aspirating conduits for all cylinders, said other cylinder being separable by said second blocking means from said common aspirating conduit.

8. An internal combustion engine as defined in claim 7; and further comprising a pressure regulating valve, said accumulating container being connected with said aspirating conduit for all cylinders through said pressure regulating valve.

9. An internal combustion engine as defined in claim 7, wherein said common aspirating conduit for all cylinders has a common throttle.

10. An internal combustion engine as defined in claim 4; and further comprising a plurality of pistons each movable in a respective one of said cylinders, and additional outlet valves each arranged in a respective one of said additional outlets, each of said additional outlet valves being open during upward movement of the piston in the respective cylinder preceding the aspiration stroke, when the respective cylinder is separated from said fuel supply means.

11. An internal combustion engine as defined in claim 10, wherein each of said cylinders has a normal outlet and a normal outlet valve arranged in the latter for normal operation, said normal outlet valve being open during a piston stroke serving as a working stroke when the respective cylinder is separated from said fuel supply means.

12. An internal combustion engine as defined in claim 10; and further comprising electronic performance controlling means arranged for controlling fuel supply of said fuel supply means, blocking of at least one of said cylinders from said fuel supply means, and opening and closing of said additional outlet valves.

13. An internal combustion engine as defined in claim 4, wherein said cylinders each have a branching passage extending from said outlet passage and communicating with said accumulating container, and a reverse valve arranged in said outlet passage prior to said branching passage.

14. An internal combustion engine as defined in claim 13; and further comprising electronic performance controlling means arranged for controlling fuel supply of said fuel supply means, blocking of at least one of said cylinders from said fuel supply means, and controlling of said reverse valves.

15. An internal combustion engine as defined in claim 13, wherein said reverse valve is movable between a first position in which it opens said outlet passage and closes said branching passage, and a second position in which it fully opens said branching passage and closes said outlet passage.

16. An internal combustion engine as defined in claim 15, wherein said cylinders includes a cylinder which is not separable from said fuel supply means, one of said reverse valves being also provided in said not separable cylinder for return of exhaust gases.

* * * * *